US005865327A

United States Patent [19]

Johnston

[11] Patent Number: 5,865,327

[45] Date of Patent: Feb. 2, 1999

[54] HYDRAULIC BOOM FOR GANTRY AND THE LIKE

[75] Inventor: Roger L. Johnston, Muskego, Wis.

[73] Assignee: J & R Engineering Co., Inc., Big Bend, Wis.

[21] Appl. No.: 971,333

[22] Filed: Nov. 4, 1992

Related U.S. Application Data

[63] Continuation-in-part of Ser. No. 887,232, May 19, 1992, abandoned, which is a continuation of Ser. No. 426,597, Oct. 24, 1989, abandoned.

[51] Int. Cl.[6] ..... B66B 11/00

[52] U.S. Cl. ..... 212/343; 212/292; 212/314; 212/343; 104/126

[58] Field of Search ..... 414/287, 460–461, 414/560–561; 212/199, 204, 230, 264, 314, 324, 343, 344, 292; 104/126

[56] References Cited

U.S. PATENT DOCUMENTS

| | | | |
|---|---|---|---|
| 3,090,494 | 5/1963 | Thiele | 212/208 |
| 3,335,875 | 8/1967 | Fachinetti | 212/208 |
| 3,398,492 | 8/1968 | Nansel . | |
| 3,462,023 | 8/1969 | Grove | 212/268 |
| 3,795,321 | 3/1974 | Johnston | 212/268 |
| 3,841,494 | 10/1974 | Chalupsky et al. . | |
| 4,036,372 | 7/1977 | Rao et al. . | |
| 4,260,064 | 4/1981 | Ekstam | 212/268 |
| 4,350,255 | 9/1982 | Blase et al. . | |
| 4,381,839 | 5/1983 | Engler et al. | 212/208 |
| 4,573,853 | 3/1986 | Lorenz | 414/460 |

FOREIGN PATENT DOCUMENTS

| | | | |
|---|---|---|---|
| 2476727 | 8/1981 | France . | |
| 2254290 | 5/1973 | Germany | 212/184 |
| 2247491 | 4/1974 | Germany . | |
| 2439667 | 3/1976 | Germany . | |
| 2752415 | 5/1979 | Germany | 212/184 |
| 49748 | 4/1979 | Japan | 212/268 |
| 688419 | 10/1979 | U.S.S.R. | 212/208 |
| 992397-A | 2/1983 | U.S.S.R. . | |
| 1404136 | 8/1975 | United Kingdom | 212/184 |

*Primary Examiner*—Karen M. Young
*Assistant Examiner*—Raymond B. Johnson
*Attorney, Agent, or Firm*—Ryan Kromholz & Manion

[57] ABSTRACT

A hydraulic boom gantry and a method of lifting a load associated therewith. The gantry includes telescoping sections with a hydraulic cylinder mounted therein. A swiveling plate structure allows minor deviation between sets of telescoping sections. A collar structure and a pinning structure lock the telescoping sections together. A cam mechanism prevents accidental section retraction and a powered rigging device traverses a beam connecting the telescoping sections.

9 Claims, 15 Drawing Sheets

HYDRAULIC BOOM FOR GANTRY AND THE LIKE

BACKGROUND OF THE INVENTION

This application is a continuation in part of U.S. patent application Ser. No. 07/887,232 filed May 19, 1992, now abandoned, which is a continuation of U.S. patent application Ser. No. 07/426,597 filed Oct. 24, 1989, now abandoned.

This invention relates generally to an apparatus and method for lifting objects and, more particularly, to an apparatus and method for lifting heavy objects with an extendable boom gantry.

Various systems and methods for lifting heavy objects have been developed over thousands of years. Traditional gantries are well known in the prior art for their usefulness for lifting heavy objects. However, a satisfactory system for vertically extending the gantry boom has eluded those skilled in the gantry art. In particular, a number of design concerns must be addressed in developing a satisfactory gantry.

One prior art design utilizing jacks that can be in the form of telescopic lifting rams is disclosed by German Patent No. 2439667. While this structure allows vertical extension, structural limitations of traditional hydraulic cylinders may allow this structure to lift a heavy load to a point where the structure can no longer support the load. This is at least partly attributable to the fact that traditional hydraulic cylinders are designed to be strong in tension and compression, but fail at relatively low bending stress. Accordingly, a relatively simple structure for vertically extending the boom on a gantry while providing sufficient strength to withstand bending stress is needed.

To achieve substantial vertical lift heights, multi-stage hydraulic cylinders can be used. However, multi-stage hydraulic cylinders are expensive and heavy and the expense and weight increases with the overall extended length of the cylinder. Accordingly, it is desirable to provide a method of extending a lifting structure which is capable of extension greater than the extended length of the hydraulic cylinder.

Still another design concern is that it is difficult to precisely coordinate the extension of two hydraulic cylinders. In addition, it is difficult to coordinate two sets of driving wheels. Such lack of coordination can cause structural failure when a rigid gantry structure is attached to said mechanisms. Accordingly, means for allowing slight misalignments while retaining the structural integrity of the gantry structure are critically needed.

Finally, hydraulic systems occasionally fail by losing pressure. In a gantry system, such failure can cause catastrophic results because the load may drop in conventional designs. Accordingly, a safety feature which is independent of the hydraulic system for its holding force while being actuated by the hydraulic system failure is needed.

It is therefore an object of the invention to provide a new and improved apparatus and method for lifting heavy objects.

It is still another object of the invention to provide an improved apparatus and method for lifting objects with an extendable boom.

It is yet another object of the invention to provide a novel apparatus and method for lifting heavy objects utilizing a vertically extendable gantry structure.

It is still a further object of the invention to provide a vertically extendable gantry capable of extension greater than its lift cylinder extension range.

It is still another object of the invention to provide a vertically extendable gantry having a connection between a beam and extendable legs which allows slight misalignment of the legs while preventing large misalignments which can result in structural instability.

It is yet another object of the invention to provide a vertically extendable gantry having a safety mechanism which provides mechanical locking force when pressurized extension means fail.

It is still a further object of the invention to provide a vertically extendable gantry capable of moving the load under power in two perpendicular directions.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, wherein like-referenced numerals identify like elements, and wherein:

DESCRIPTION OF PREFERRED EMBODIMENTS

Figure 1:
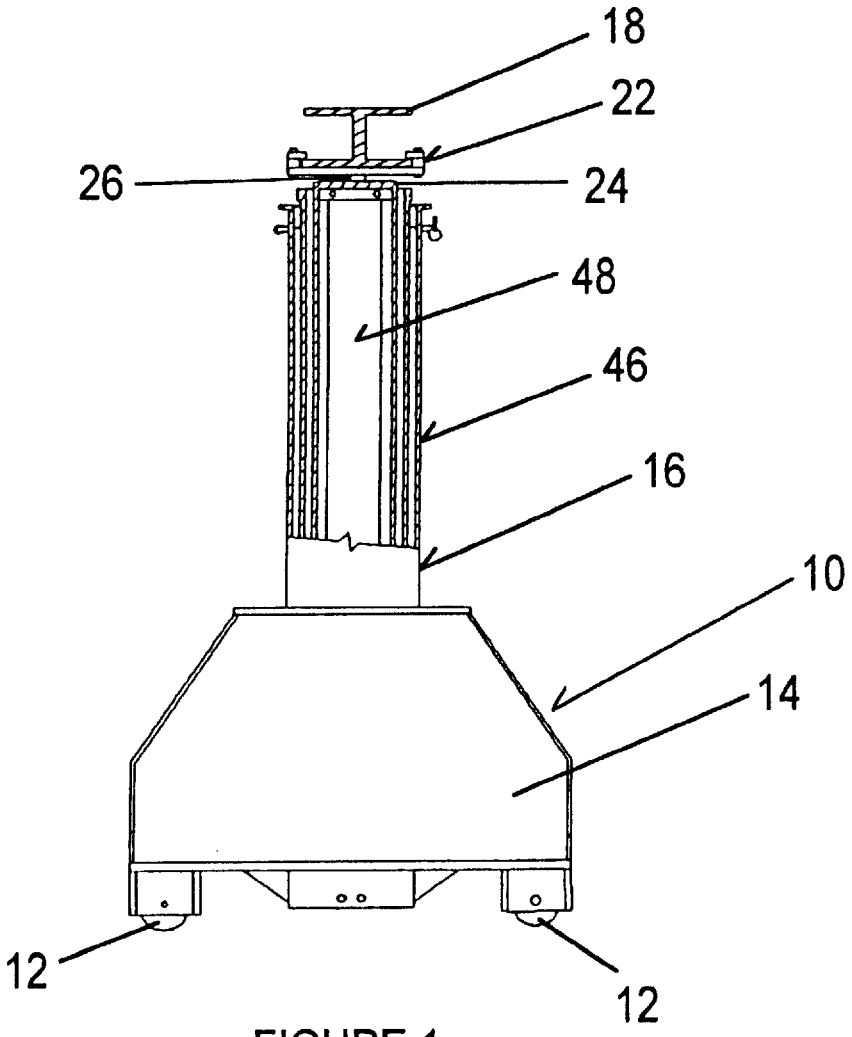
FIG. 1 is a front elevational view of a gantry constructed in accordance with one aspect of the present invention in its fully lowered configuration, having cross-sectional details of the extendable portion of the boom assembly shown.

Referring to the drawings, a hydraulic boom gantry 10 constructed in accordance with one aspect of the invention is shown in FIGS. 1–6.

As illustrated, the hydraulic boom gantry 10 includes two sets of wheels 12 with one base 14 mounted on each set of wheels 12. Lifting legs 16 are attached to each of the bases 14. A beam 18 is connected to the top of the lifting legs 16. Various rigging devices 20 may be mounted on the beam 18, which, in turn, is supported by the lifting legs 16 and the bases 14. The rigging devices 20 can include conventional chains, cables or the like that can be used to connect the load to the beam 18 or can include the powered rigging device 20 disclosed in FIGS. 17–19.

The bases 14 and lifting legs 16 are kept in substantially parallel alignment with one another by the beam 18 and a header plate structure 22. Preferably, a swiveling header plate 22 is used to connect the beam 18 to an innermost section 24. As shown in FIGS. 1–6 and 14–16, the swiveling header plate 22 comprises a hemispherical bearing 26. The bearing 26 is mounted so as to allow relatively small differences in height between the lifting legs 16 and relatively small misalignments of the bases 14. Larger misalignments are limited by the clearances around the bearing 26. As a larger deviation starts to occur, it is limited by binding contact between the upper bearing structure 28 and the outer bearing cup exterior 30. The clearance between the upper bearing structure 28 and the outer bearing cup exterior 30 can be varied with plates, shims or the like to vary the amount of unchecked deviation.

Figure 14:
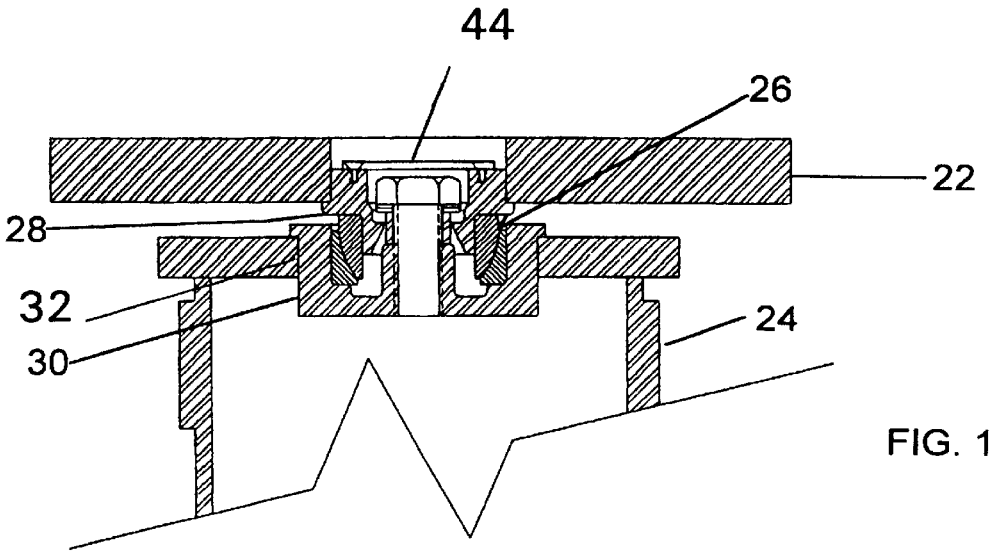
FIG. 14 is a cross-sectional view of a header plate in a neutral position.
Figure 15:
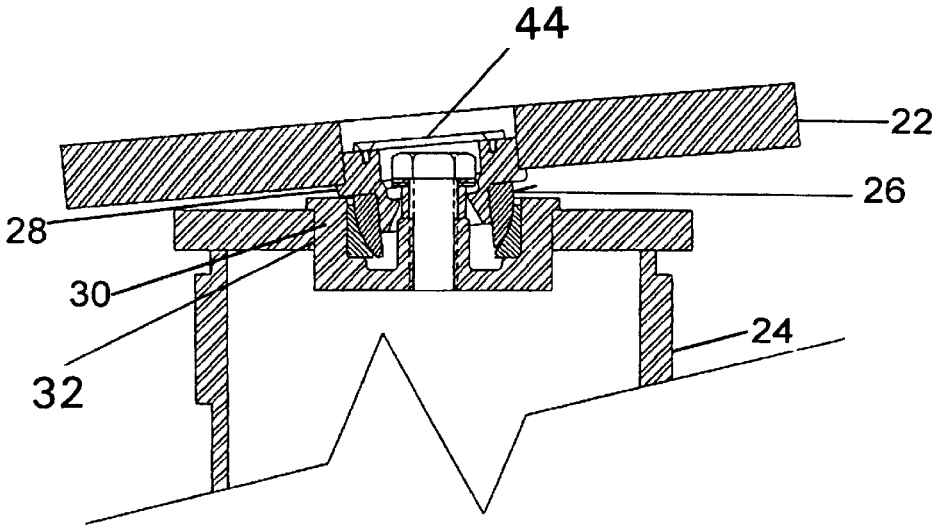
FIG. 15 is a cross-sectional view of a header plate in a fully tilted position.
Figure 16:
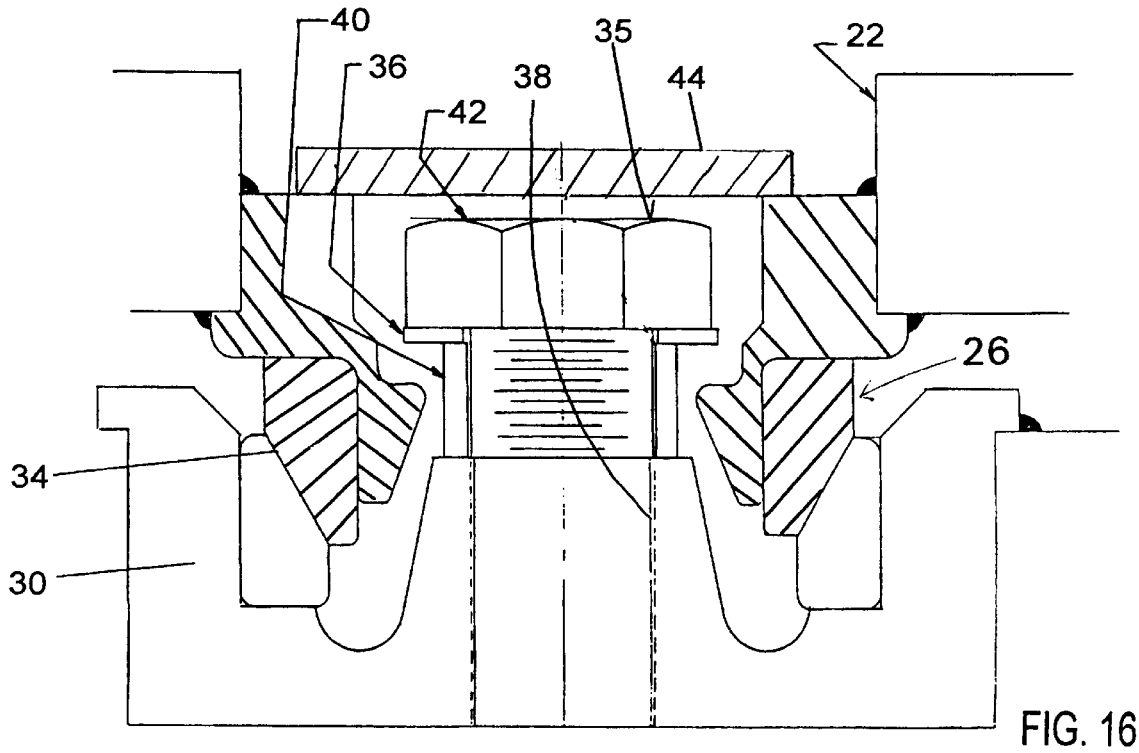
FIG. 16 is an expanded cross-sectional view of the header plate in a neutral position.

As shown in FIGS. 14–16, the hemispherical bearing 26 comprises components located in and between the top of the innermost section 24 and the header plate 22. The innermost section 24 includes the outer bearing cup 30 which is pressed into place in a pocket 32. The outer bearing cup 30 includes an inner bearing cone 34 therein. After the header plate 22, the upper bearing structure 28, the hemispherical bearing 26, and the inner bearing cone 34 are positioned in the outer bearing cup 30 of the innermost section 24, a connecting bolt assembly 35 is used to retain the header plate structure 22 in an operating configuration. A spacer 40 is placed over the threaded hole 38 of the outer bearing cup 30. Next, a washer 36 is placed over the spacer 40 and a bolt 42 is inserted into the threaded hole 38 and tightened securely. Finally, a cover plate 44 is bolted into place over the top of the bolt 42 head. In this way, the lifting legs 16 are securely fastened to the beam 18 while still allowing minor misalignments to occur without causing structural failure.

Extension of the lifting legs 16 permits lifting of the load by the beam 18 and rigging devices 20 as desired. The lifting legs 16 also include telescoping outer and intermediate sections 46 and 50 preferably made of square structural tubing. Though it will be readily preferably apparent to one skilled in the art that various materials may be used for the hydraulic boom gantry 10 components, steel is preferably used in the preferred embodiment described herein. Though the number of telescoping boom sections 46, 50 and 24 used in a particular hydraulic boom gantry 10 can be varied, a hydraulic boom gantry 10 having three telescoping boom sections 46, 50 and 24 is shown in the Figures and will be referred to for illustrative purposes.

Although various pressurized cylinder means can be used equivalently, a hydraulic cylinder 48 is described for nonlimiting, illustrative purposes. A conventional multiple telescoping stage hydraulic cylinder 48 (FIG. 2A) mounted in an inverse orientation is preferably disposed within the interior of the telescoping boom sections 46 as shown in FIGS. 1–4. The inverse orientation of the cylinder 48 places the input and output ports of the cylinder 48 at a stationary position at the bottom of the lifting legs 16. Thus, complex hydraulic hose reels are not required to provide additional hydraulic hose length when the cylinder 48 extends and to take up excess hose length as the cylinder 48 retracts.

This inverse orientation of the cylinder 48 also provides greater and more consistent bending moment resistance throughout the boom structure 10 by placing the largest and strongest part of the cylinder in the weakest and smallest boom sections (the innermost section 24 and the immediately adjacent intermediate section 50). Also, any air which enters the hydraulic cylinder 48 rises to the top of the barrel portion 52 (in its inverse orientation) where it may be easily purged from the cylinder 48. As the cylinder 48 is extended under pressure from a conventional hydraulic pump, the telescoping sections can be extended from a fully retracted position.

Figure 2:
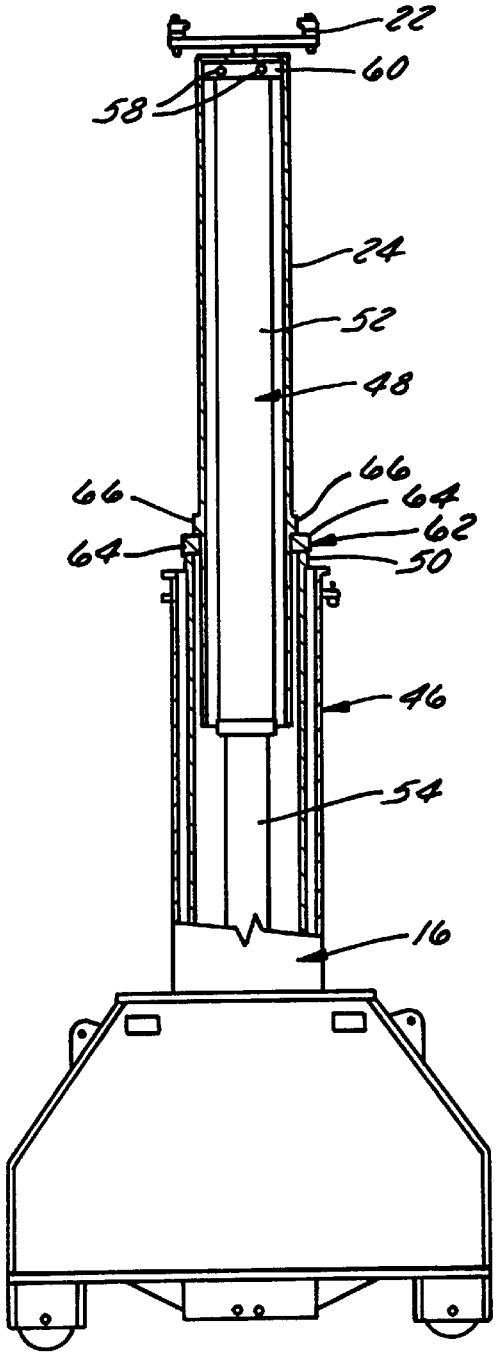
FIG. 2 is a front elevational view of the boom assembly in a fully extended innermost section configuration with the cylinder fully extended and a lock collar in place.
Figure 2A:
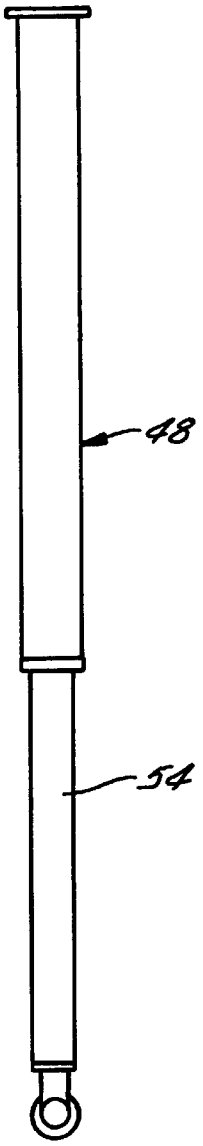
FIG. 2A is a front elevation view of a multistage hydraulic cylinder incorporated in the gantry.

A preferred embodiment of the invention, which includes inner section 24, the immediately adjacent intermediate section 50 and an additional section 46, is described for nonlimiting, illustrative purposes. If extension of the innermost section 24 is desired from the fully-retracted position as shown in FIG. 1, the lock pins 58, which lock the innermost section 24 in position with the adjacent intermediate section 50 in the cylinder pinning block 60, are removed. The hydraulic cylinder 48 may need to be extended or retracted slightly to relieve binding pressure on the lock pins 58. Once the lock pins 58 are removed from the cylinder pinning block 60, the hydraulic cylinder 48 can be extended. As the hydraulic cylinder 48 extends, it presses against the top inner surface of the innermost section 24 and coordinately extends the innermost section 24 as shown in FIG. 2.

Figure 3:
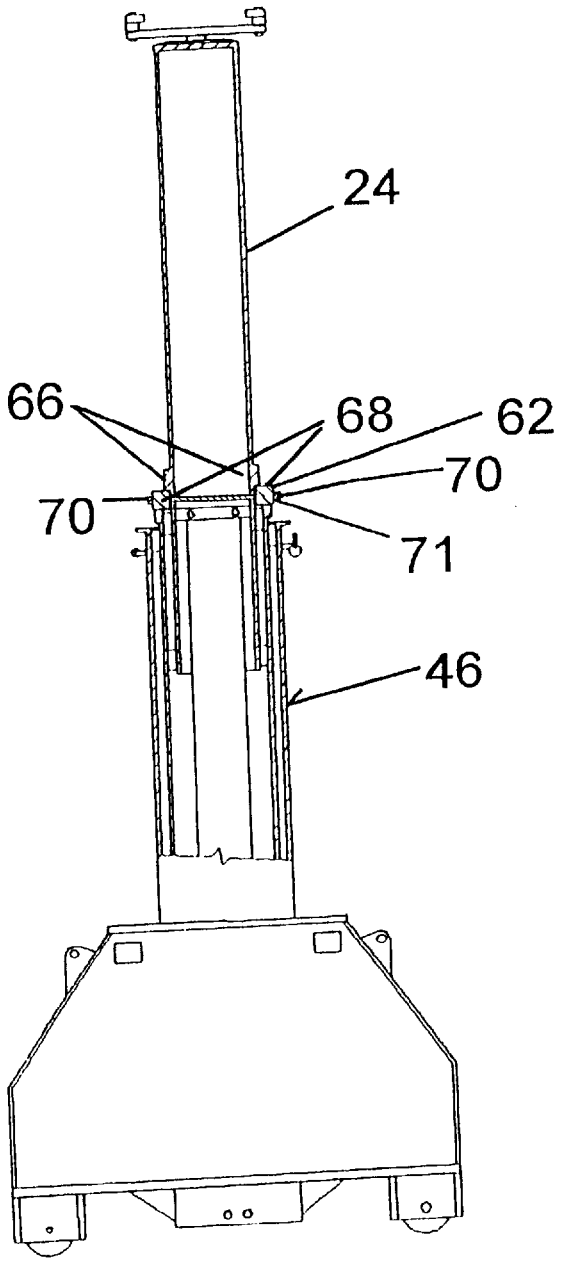
FIG. 3 is a front elevational view of the boom assembly in its fully extended innermost section configuration with the cylinder retracted and an alternative embodiment of the lock collar in place.
Figure 4:
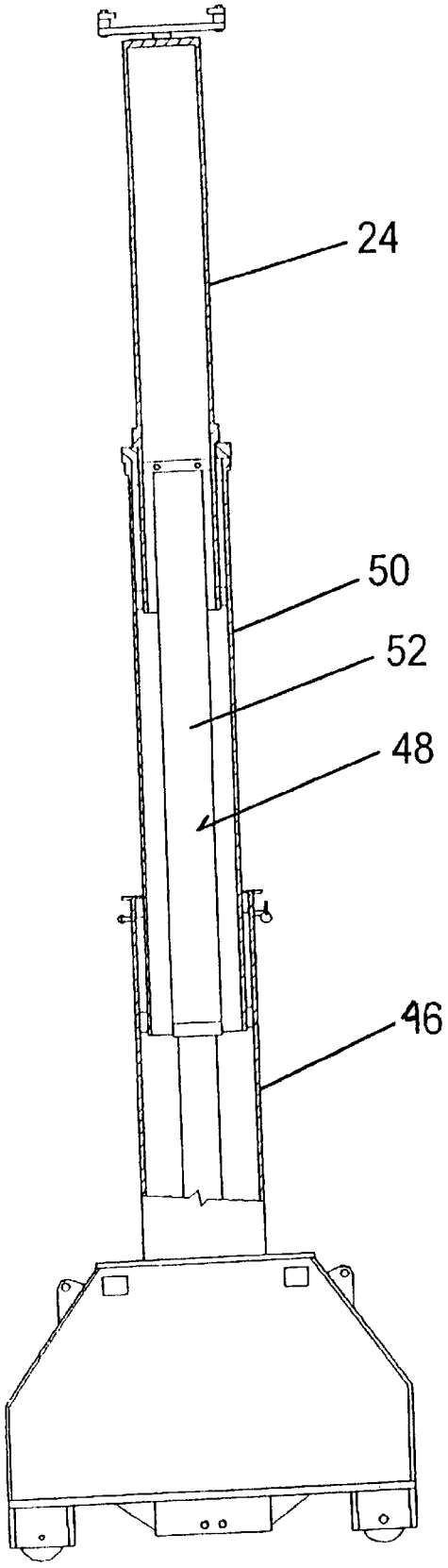
FIG. 4 is a front elevational view of the boom assembly with its innermost section fully extended and the immediately adjacent intermediate section partially extended.

If additional hydraulic boom gantry 10 height is desired, the innermost section 24 is locked in place with the lock collar 62. The lock collar 62 can consist of two rectangular steel blocks 64 which are inserted between the shear plates 66 and the top perimeter of the adjacent intermediate section 50 as shown in FIG. 2. Alternatively, the lock collar 62 can consist of two rectangular blocks 68 having holes at both ends through which retaining bolts 70 can be inserted. The retaining bolts 70 are long enough to extend through both blocks 68 when the blocks 68 are inserted opposite each other under the shear plates 66 as shown in FIG. 3. Retaining nuts 71 are threaded onto retaining bolts 70 to fasten the blocks 68 in place. It will be obvious to one skilled in the art that the lock collar 62 structure can be modified in many conventional ways.

After installing the lock collar 62, the innermost section 24 is retracted slightly until the shear plates 66 contact the lock collar 62. This locks the innermost section 24 in place in its extended position with the lock collar 62 supporting the load. The hydraulic cylinder 48 can then be retracted within the locked innermost section 24. When the hydraulic cylinder 48 is fully retracted, both lock pins 58 are inserted into the holes in the adjacent intermediate section 50, the lower part of the innermost section 24 and the cylinder pinning block 60. In this way, the adjacent intermediate section 50 and the innermost section 24 extend coordinately with the hydraulic cylinder 48 as it extends. If additional extension is desired, another lock collar 62 is used to lock the adjacent intermediate section 50 in its fully extended position. Thereafter, an additional intermediate section (not shown) is extended in the same manner as the adjacent intermediate section 50. This technique can be used for additional sections as well.

Figure 8:
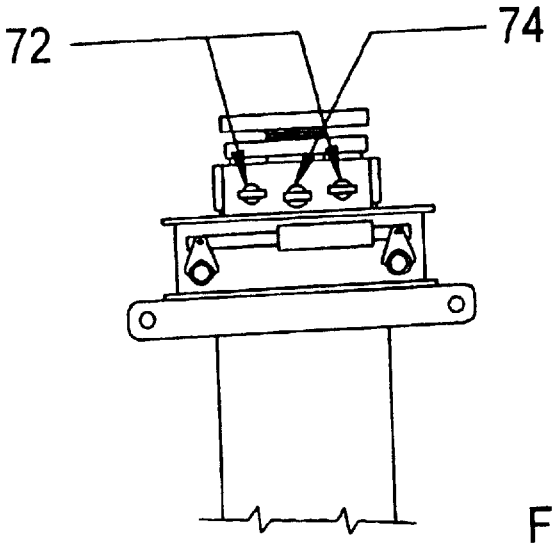
FIG. 8 is a front elevational view of an alternative embodiment of the boom assembly with the boom pins and cylinder pin in place.

Alternatively, each lifting leg 16 is provided with two boom pins 72 and one cylinder pin 74 as shown in FIG. 8. The two boom pins 72 are located on either side of the cylinder pin 74 as shown. Though various diameters may be used, the cylinder pin 74 is preferably 1.75 inches in diameter and the boom pins 72 preferably have diameters of 1.5 inches.

Figure 9:
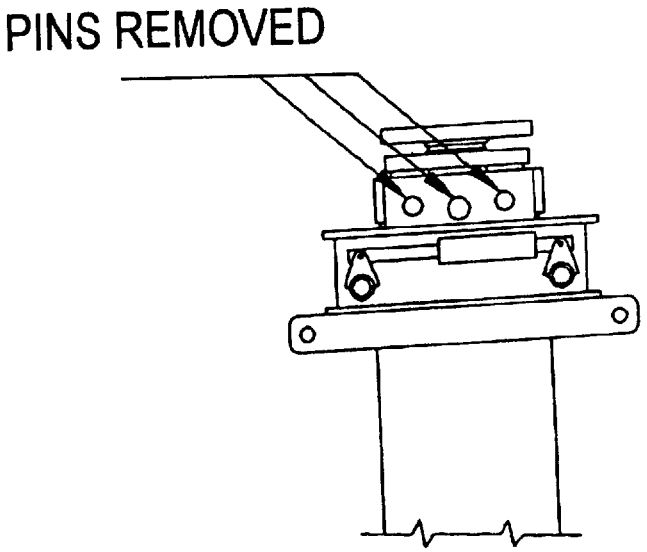
FIG. 9 is a front elevational view of the boom assembly in its fully retracted position with the boom and cylinder pins removed.
Figure 10:
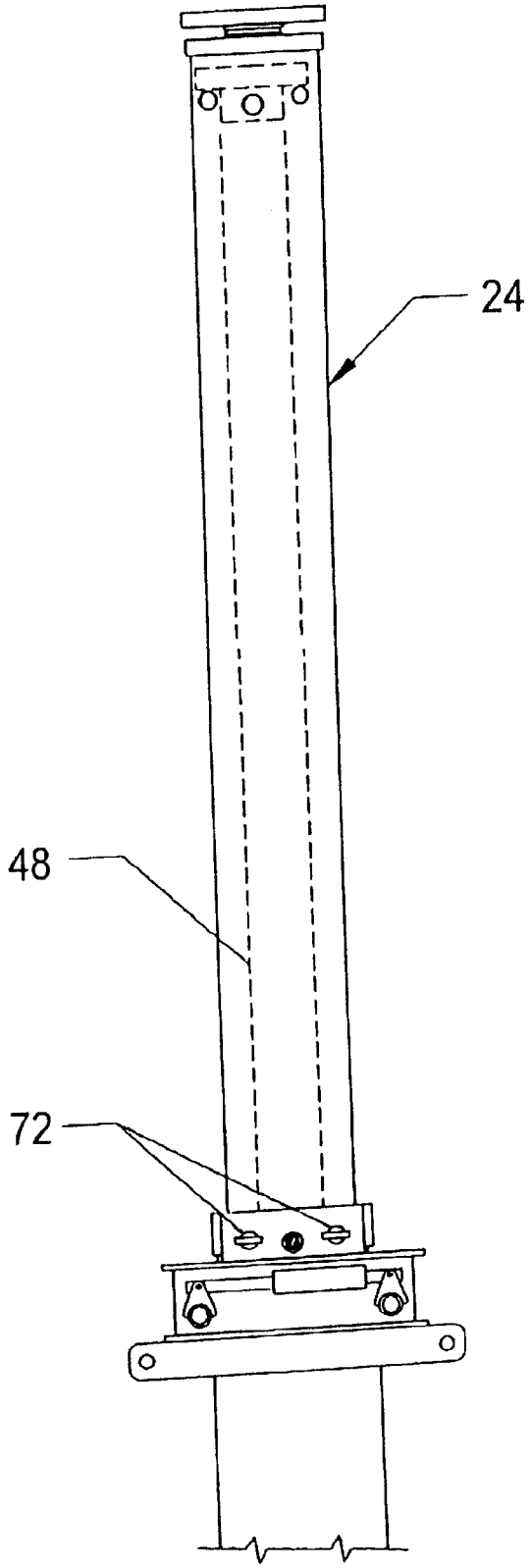
FIG. 10 is a front elevational view of an alternative embodiment of the boom assembly with the innermost section extended before pin insertion.
Figure 11:
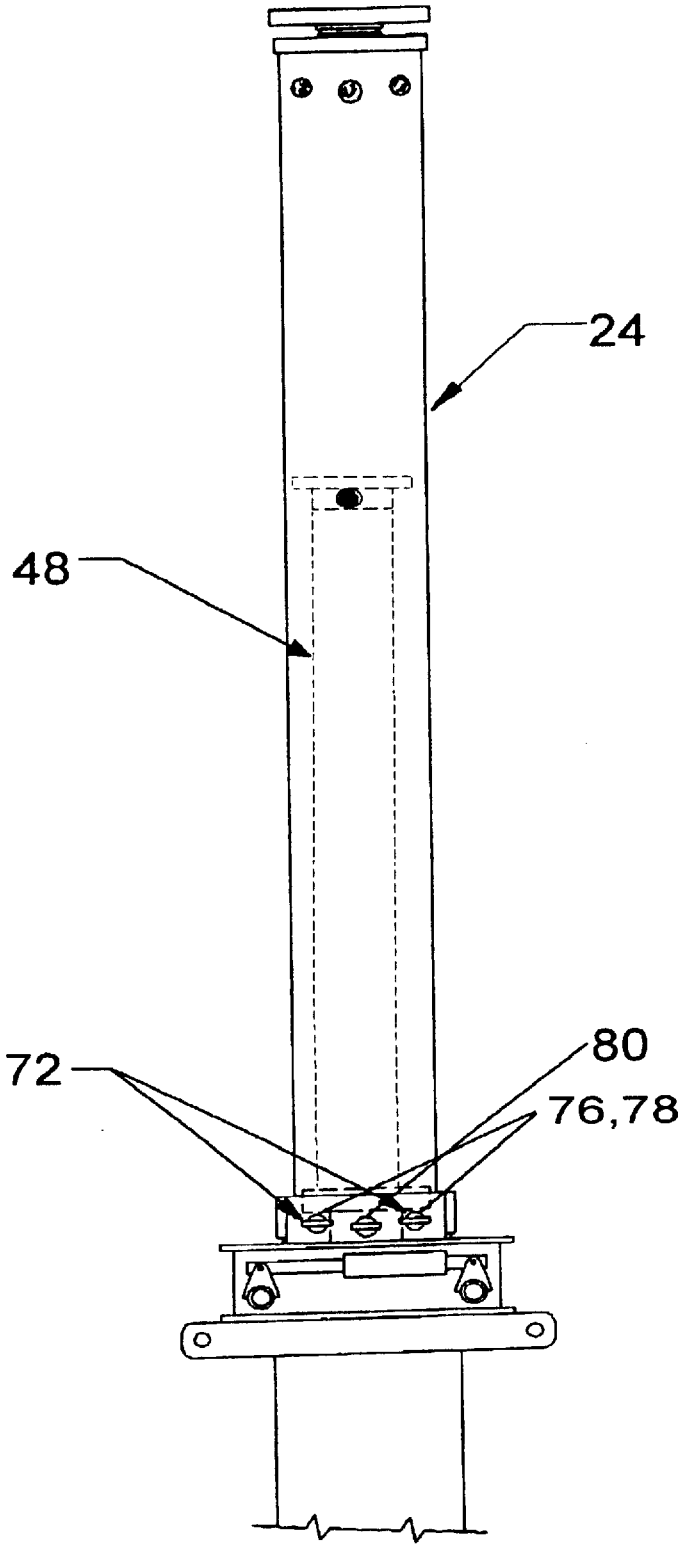
FIG. 11 is a front elevational view of the boom assembly with the innermost section pinned in place by the boom pins and hydraulic cylinder partially retracted.
Figure 12:
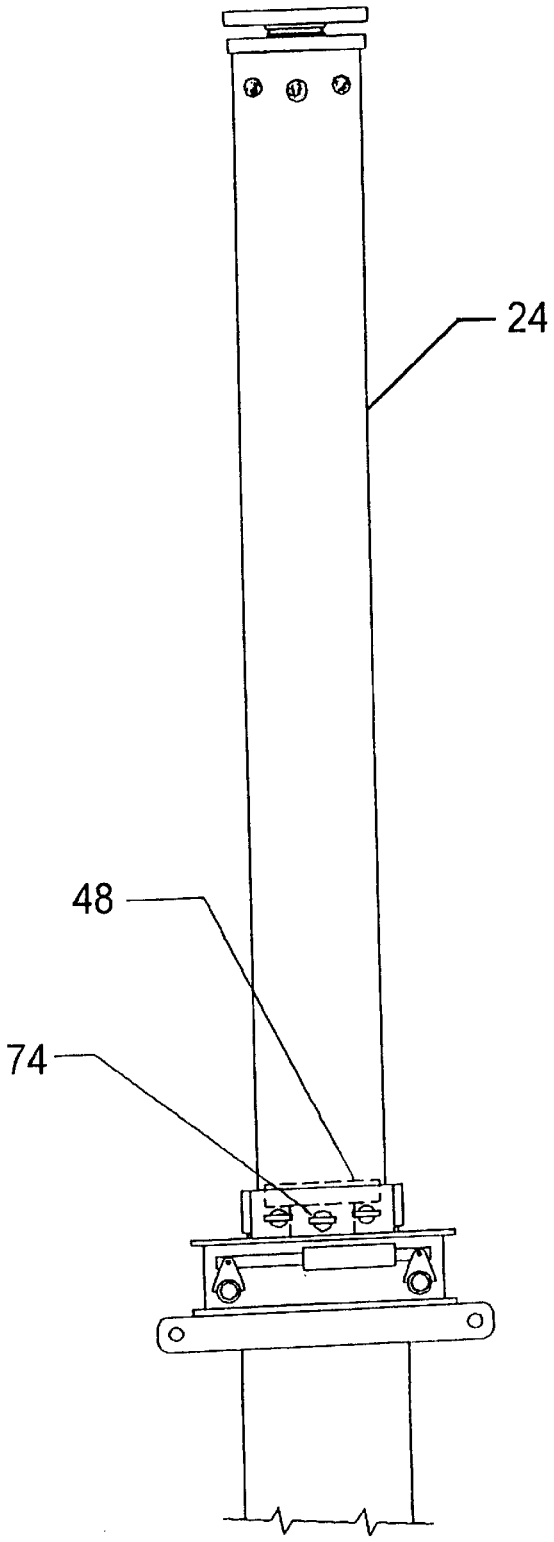
FIG. 12 is a front elevational view of the boom assembly with the innermost section fully extended and locked in place with the boom and cylinder pins.
Figure 13:
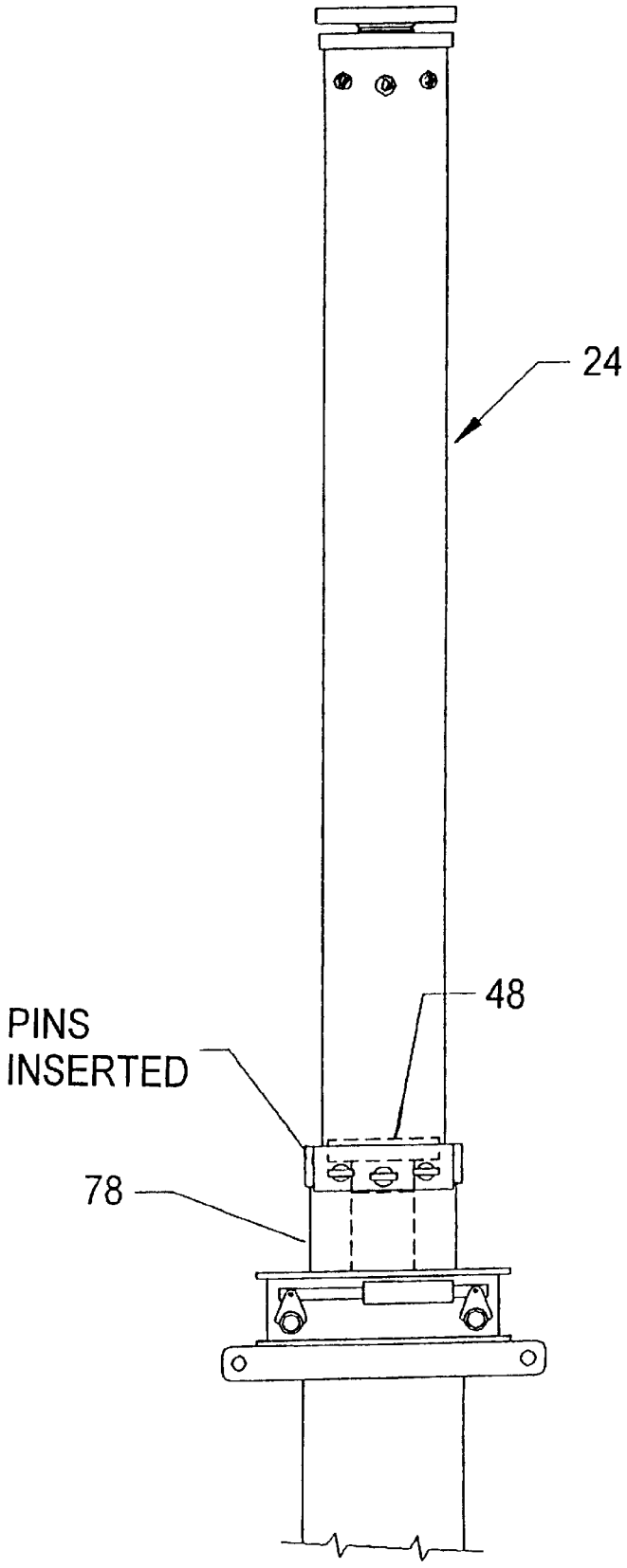
FIG. 13 is a front elevational view of the boom assembly with the innermost section pinned in place and a hydraulic cylinder lifting the immediately adjacent intermediate section and the innermost section therewith.

Extending the telescoping sections 46, 50, and 24 requires the following steps: First, while the sections 46, 50, and 24 are fully retracted, the boom pins 72 and the cylinder pin 74 are removed as shown in FIG. 9. In some instances, the hydraulic cylinder 48 may need to be extended slightly to remove binding pressure from the cylinder pin 74. Next, the hydraulic cylinder 48 is extended. The innermost section 24 is extended coordinately with the hydraulic cylinder 48. If extension greater than the height provided by the innermost section 24 is desired, the hydraulic cylinder 48 is fully extended until the pinning holes 76 formed in the upper end of the adjacent section 50 become aligned with the pinning holes 78 formed in the lower end of the innermost section 24 as shown in FIG. 11. Once the pinning holes 76, 78 are aligned, the pins 72 are fully inserted in the pinning holes 76. This locks the innermost section 24 to the adjacent intermediate section 50. The hydraulic cylinder 48 may then be retracted within the innermost section 24 as shown in FIG. 11. The hydraulic cylinder 48 is retracted until a pinning hole 80 formed in the cylinder end of the hydraulic cylinder 48 is aligned with the adjacent intermediate section hole 76 and a cylinder pin 74 is inserted as shown in FIG. 12. Extension of the cylinder 48 now coordinately raises the adjacent intermediate section 50 and the innermost section 24 pinned thereto. Additional sections may be extended in the same manner. Specifically, the adjacent intermediate section 50 can be pinned to an additional intermediate section and the hydraulic cylinder lowered and reconnected to the pinned together sections to raise the combination.

Retraction of the sections is performed as follows: the adjacent intermediate section 50 is retracted with the hydraulic cylinder 48 until the cylinder pin 74 is freed from binding pressure. The cylinder pin 74 is then removed and the hydraulic cylinder 48 is extended until the pins 72 become free from binding pressure. The pins 72 are then removed and the hydraulic cylinder is retracted until both the pin holes 76 and the cylinder hole 80 are aligned with the holes 78 in the innermost section 24. The innermost section 24 is retracted in the same fashion.

In both preferred embodiments, the pinning configurations provide additional structural strength and safety. Additional structural strength over conventional designs is provided by using the pins to fix the hydraulic cylinder 48 sections to the sections 46, 50, and 24, rather than using a single pin for a pivotal connection. While a pivotal connection does not allow bending stresses applied to the boom sections to be partly transferred to the hydraulic cylinder 48 sections, the pinned connections provided by the preferred embodiments effectively transfer such stresses, thereby significantly increasing structural strength. Further, pin removal may not occur until binding pressure is relieved. Therefore, the load will not drop due to inadvertent pin removal.

Figure 5:
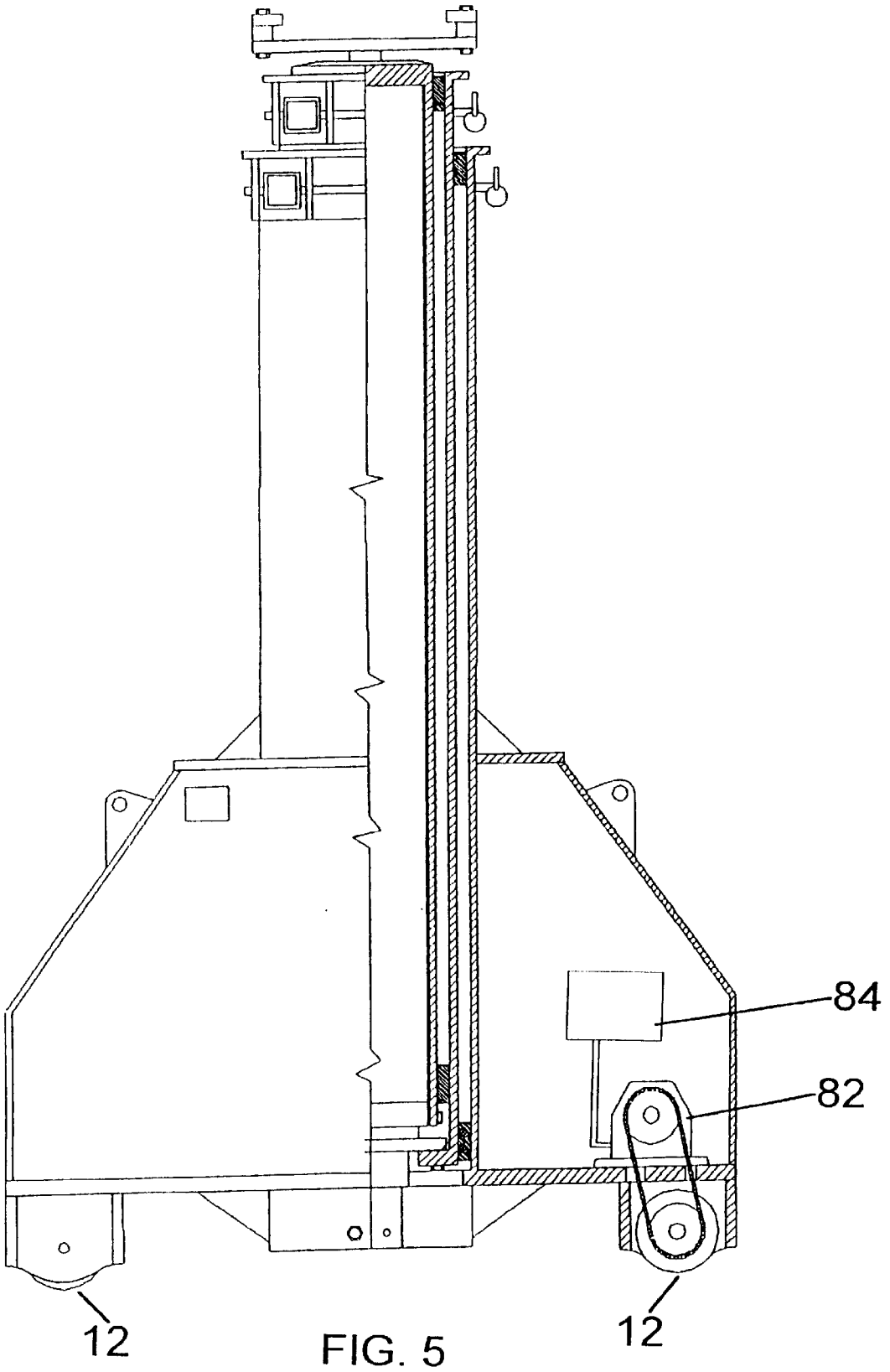
FIG. 5 is a front elevational view of the boom assembly in its fully lowered configuration having cutouts showing the boom assembly nesting structure and a driving means.

As shown in FIG. 5, one or more wheels 12 for each of the bases 14 can be driven by a motor 82. It will be obvious to one skilled in the art that an alternative drive structure can be used. The motors 82 are preferably controlled by a central control panel 84.

Figure 19:
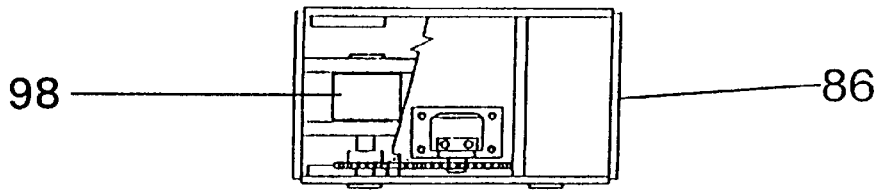
FIG. 19 is a cross-sectional top view of the powered rigging device of FIG. 17.
Figure 18:
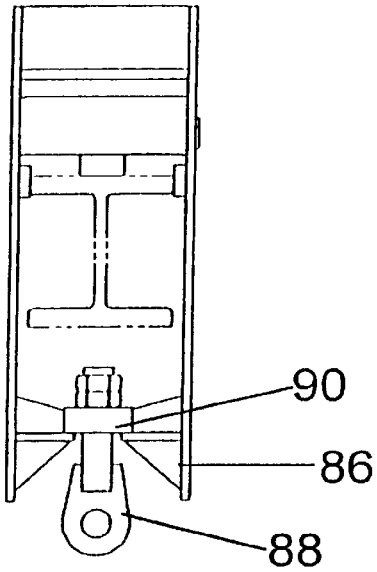
FIG. 18 is a cross-sectional side view of the powered rigging device of FIG. 17.
Figure 17:
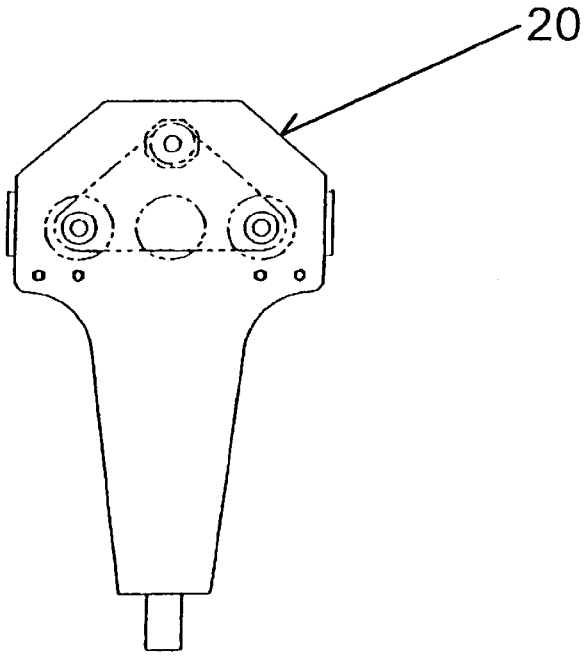
FIG. 17 is a cross-sectional front view of a powered rigging device.

Another embodiment of the invention uses a powered rigging device 20. As shown in FIGS. 17–19, the powered rigging device 20 is propelled by a rigging device motor 98 so that it may traverse the beam 18 while carrying a load. This rigging device motor 98 is preferably operated by the central control panel 84 which controls the powered movement of the bases 14. The rigging device 20 preferably includes a housing 86 supporting a hook or other rigging fixture 88 which includes a swivel bearing 90 (as shown in FIG. 18) so that the load may be rotated easily without fixture entanglement.

Figure 6:
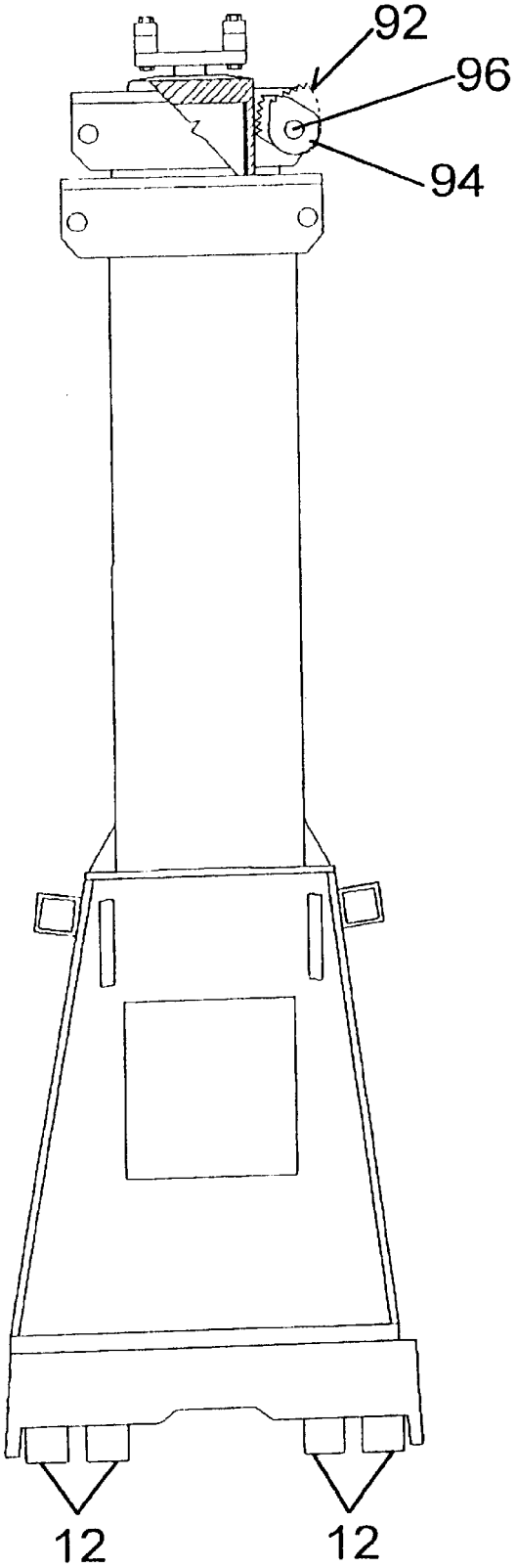
FIG. 6 is a side elevational view of the boom assembly in its fully lowered position, showing the cam-locking mechanism engaging the adjacent intermediate section and in its disengaged configuration (dotted outline)
Figure 7:
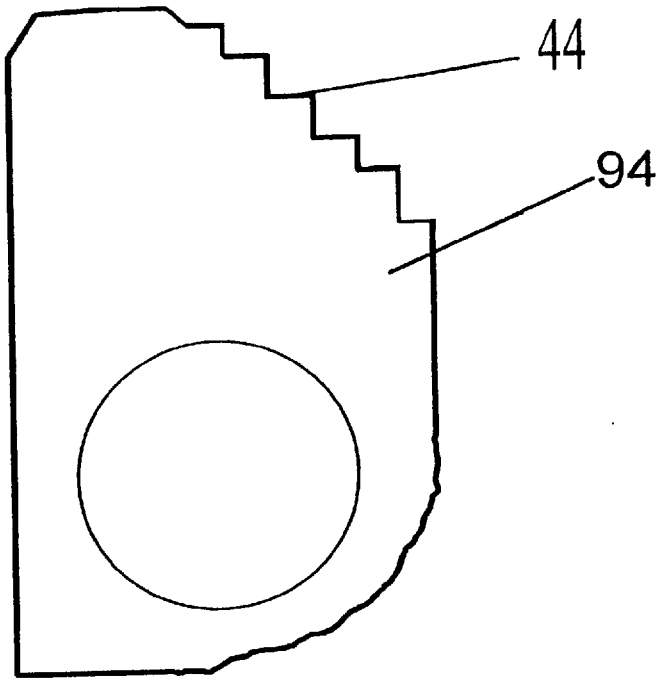
FIG. 7 is a front elevational view of the cam.

A cam-locking mechanism 92 is also provided as an additional safety feature. This mechanism 92 comprises a toothed cam 94 as shown in FIGS. 6 and 7. The cam-lock mechanism 92 is mounted on a support 96 which allows rotation about the support 96. The cam-lock mechanism 92 is retained in its disengaged position by hydraulic pressure. If the hydraulic pressure drops to a level where the hydraulic cylinder 48 might begin to retract unexpectedly, the cam-lock mechanism 92 rotates under spring pressure to engage the boom section to which it is mounted. This engagement prevents retraction of the lifting legs 16, thus preventing unexpected lowering of the load.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

What is claimed is:

1. An extendible leg assembly for use in a gantry crane, said extendible leg assembly comprising:

a base;

a plurality of telescoping sections, each having an upper end and a lower end, mounted on said base for vertical extension relative to said base, said plurality including an innermost section, an outermost section and an intermediate section immediately adjacent said innermost section;

not more than one hydraulic cylinder, having an upper end and a lower end, disposed vertically within said telescoping sections with said lower end adjacent said base and said upper end engageable with said upper end of said innermost section;

a detachable connection for detachably coupling said upper end of said cylinder to said adjacent intermediate section; and a selectively engageable connection between said lower end of said innermost section and said upper end of said adjacent intermediate section for detachably fixing said innermost section and said adjacent intermediate section to each other with said innermost section being extended relative to said adjacent intermediate section;

said extendible leg assembly thereby being extendible over a range that is greater than the available extension of said cylinder.

2. An extendible leg assembly as defined in claim 1 wherein said selectively engageable connection includes one or more pins insertable through substantially coaxially aligned holes formed through said lower end of said innermost section and said upper end of said adjacent intermediate section.

3. An extendible leg assembly as defined in claim 2 wherein said pins are of substantially circular cross section.

4. An extendible leg assembly as defined in claim 1 wherein said detachable connections include coaxially alignable holes formed through said upper end of said cylinder and said innermost or intermediate sections and a pin insertable through said coaxially aligned holes to secure said upper end to either said innermost section or said adjacent intermediate section.

5. An extendible leg assembly for use in a gantry crane, said extendible leg assembly comprising:

a base;

a plurality of telescoping sections, each having an upper end and a lower end, mounted on said base for vertical extension relative to said base, said plurality including an innermost section, an outermost section and an intermediate section immediately adjacent said innermost section;

a hydraulic cylinder, having a cylinder end and a rod end, disposed within said telescoping sections with said cylinder end uppermost and said rod end lowermost, said cylinder end being engageable with and disengageable from said innermost section, a detachable connection for detachably coupling said cylinder end to said adjacent intermediate section so that said cylinder end can be coupled to either said innermost section or to said adjacent intermediate section; and a selectively engageable connection between said lower end of said innermost section and said upper end of said adjacent intermediate section for detachably fixing said innermost section and said adjacent intermediate section to each other with said innermost section being extended relative to said adjacent intermediate section;

said extendible leg assembly thereby being extendible over a range that is greater than the available extension of said cylinder.

6. An extendible leg assembly as defined in claim 5 wherein said selectively engageable connection includes one or more pins insertable through substantially coaxially aligned holes formed through said lower end of said innermost section and said upper end of said adjacent intermediate section.

7. An extendible leg assembly as defined in claim 6 wherein said pins are of substantially circular cross section.

8. An extendible leg assembly as defined in claim 5 wherein said detachable connection includes coaxially alignable holes formed in said cylinder end and said intermediate section and further includes a pin insertable through said holes in said cylinder end and said intermediate section when said holes in said cylinder end and said intermediate section are coaxially aligned.

9. An extendible leg assembly as defined in claim 8 wherein said pins are of substantially circular cross section.

* * * * *